US005894268A

United States Patent [19]

McLaren

[11] Patent Number: 5,894,268

[45] Date of Patent: Apr. 13, 1999

[54] CASSETTE AND SECURITY STRIP THEREFOR

[76] Inventor: Edwin C. McLaren, 9946 Sheffield Rd., Perrysburg, Ohio 43551

[21] Appl. No.: 09/014,876

[22] Filed: Jan. 28, 1998

[51] Int. Cl.[6] ..... G08B 13/24

[52] U.S. Cl. ..... 340/572; 340/551; 340/693

[58] Field of Search ..... 340/551, 572, 340/693

[56] References Cited

U.S. PATENT DOCUMENTS

| | | | |
|---|---|---|---|
| 4,665,387 | 5/1987 | Cooper et al. | 340/572 |
| 4,673,923 | 6/1987 | Boscoe et al. | 340/572 |
| 4,811,000 | 3/1989 | Humphrey et al. | 340/551 |
| 5,130,697 | 7/1992 | Rauscher . | |
| 5,218,342 | 6/1993 | McCrackin | 340/572 |
| 5,253,821 | 10/1993 | Johnson | 340/572 |
| 5,311,388 | 5/1994 | McLaren . | |
| 5,583,489 | 12/1996 | Loemker et al. . | |
| 5,653,824 | 8/1997 | Manning et al. . | |

*Primary Examiner*—Glen Swann

*Attorney, Agent, or Firm*—Emch, Schaffer, Schaub & Porcello Co.

[57] ABSTRACT

This anti-theft device applies a security strip directly onto the frame of an audio or video cassette. The location of the strip could be anywhere on the shell or frame. For example, one could locate it next to the UPC code on the underside of the shell, on the spine, or anywhere under the label or paperboard sheath. While the hidden strip is useful with a standard cassette and label, it is especially useful with a composite cassette having a paperboard sheath. The hidden security strip makes detection and removal virtually impossible.

9 Claims, 2 Drawing Sheets

CASSETTE AND SECURITY STRIP THEREFOR

TECHNICAL FIELD

This invention relates to an anti-theft device for video or audio tape cassettes. More specifically, the invention relates to a hidden and permanent security strip applied to video or audio tape cassettes for use in retail stores.

BACKGROUND ART

The video and music industry has long suffered a major problem with theft at the retail and commercial sales level. A common solution to the theft problem is the hand application of magnetic strips to the cassettes in the stores which will trigger a scanner alarm if they are not deactivated by the cashier. These magnetic security strips will cause an audible signal when passed through a sensing field, usually magnetic, radio frequency or acustomagnetic, if the device is not removed or deactivated where the sales transaction occurs. The use of such strips, while common, is not overly popular because application is time-consuming and the strips are often ineffective because the strips are visible which provides the thief an opportunity to peel the strips off. Thus, the industry is continually searching for anti-theft methods and devices that are more efficient and effective.

DISCLOSURE OF THE INVENTION

This anti-theft device applies the security strip directly onto the shell or frame which carries the reels and tape of the cassette. The location of the strip could be anywhere on the exterior of the shell or frame, for example, next to the UPC code on the underside of the shell, on the spine, or anywhere under the paperboard label or sheath. While the security strip of this invention is useful with a standard cassette and label, it is especially useful with the composite cassette and paperboard sheath of my U.S. Pat. No. 5,311,388. The security strips are applied by a bonding machine, to an etched down area of the shell, and then encapsulated when bonding the paperboard sheath to the shell.

Another embodiment of this invention provides a magnetized security strip and a shield member designed to prevent potential degradation of the tape signal by the magnetic field of the strip or the deactivation process. A thin foil shield is incorporated with the magnetic strip to shield the tape signal from degradation resulting from any magnetic field surrounding the security strip and its deactivation.

It is an object of this invention to provide for excellent theft deterrence because a shoplifter can not detect where the strip is located and will not be able to remove it without destroying the cassette, shell, label or sheath.

Another object of this invention is to provide a security strip which is applied to the cassette or shell during the automated process of bonding the label or sheath to the cassette or shell.

Yet another object of this invention is to eliminate the band application of security strips to the cassettes at the retail and commercial sales establishment.

Yet another object of this invention is to encapsulate the security strip between the label or sheath and shell or cassette without need for an additional application of adhesive.

BEST MODE OF CARRYING OUT INVENTION

The present invention bonds a security strip to a tape cassette or composite tape cassette. The composite tape cassette preferably is a plastic frame having a paperboard shell or sheath bonded or adhered thereto. The plastic frame is designed to enhance the structural integrity of all areas of the cassette which contact the tape playback and/or recorder unit, the tape and reels, and other areas of the cassette subject to wear and tear, such as the corners. The tape cassette of the present invention is intended for use in either video or audio format; the features of the invention remain the same.

Figure 1:
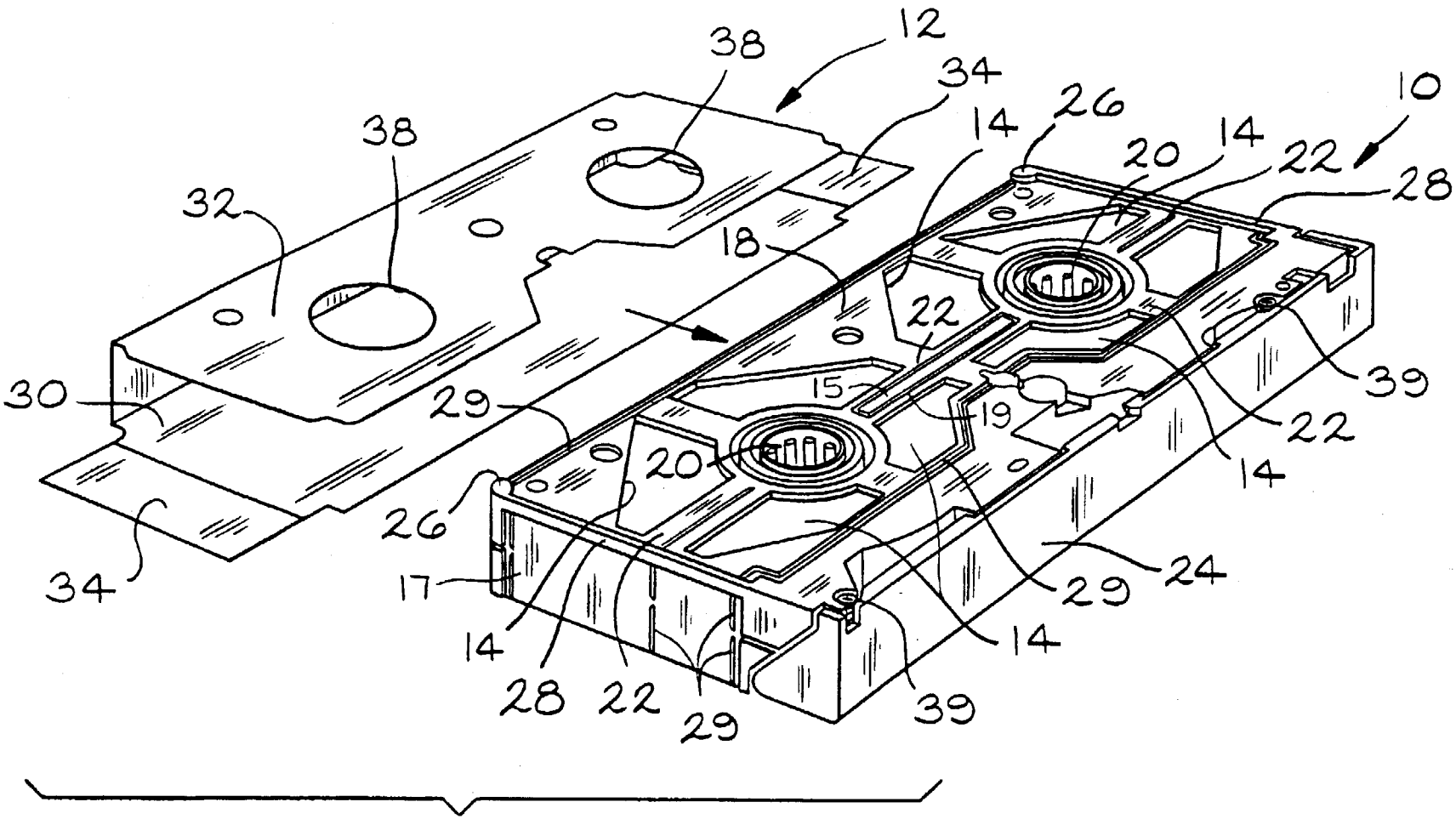
FIG. 1 is an exploded perspective view showing a tape cassette of the present invention, in video format with the plastic frame separated from the paperboard sheath, wherein the security strip is positioned on the bottom surface of the plastic frame.
Figure 2:
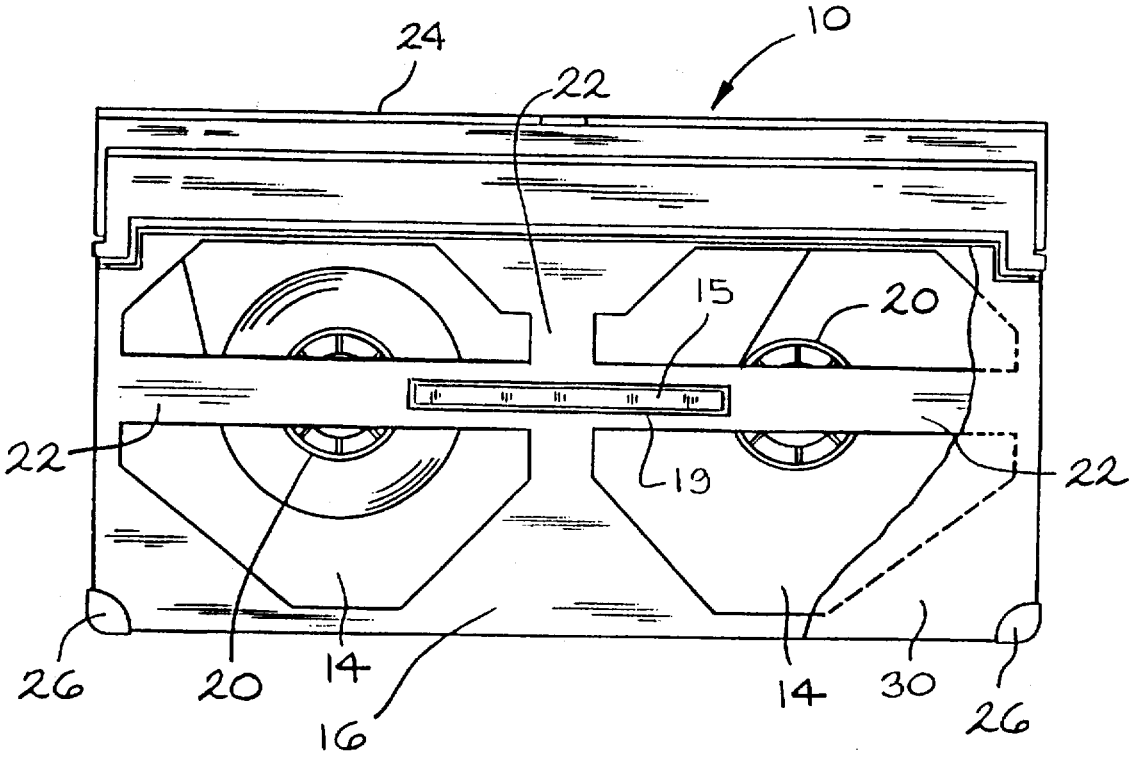
FIG. 2 is a top view showing an alternative tape cassette of the present invention, in video format, having the security strip in position on the plastic frame.

FIGS. 1 and 2 show a tape cassette intended for use as a video cassette. The tape cassette shown is designed to fit standard VHS format, however, it should be understood that video tape cassettes of any format can be made a subject of the present invention. The video tape cassette includes a frame member 10, preferably composed of a durable lightweight thermoplastic material. The frame member 10 is encased by a lightweight flexible sheath 12, preferably composed of paperboard, which is bonded to the frame member 10.

After manufacturing the frame 10 and before assembly thereof with the sheath 12, a security strip 15 is bonded to frame 10. The strip 15 may be bonded to the top surface 16 as shown in FIG. 2, bottom surface 18 as shown in FIG. 1, end surfaces 17 or side surfaces (not shown) of the frame 10. Preferably, a recess 19 is molded or manufactured into the top or bottom surface 16 or 18 and the strip 15 is adhered thereto. Any method of bonding, such as adhesive and hot melt gluing, will adhere the strip 15 to the frame 10. In a conventional cassette with no sheath bonded to the frame 10, the preferred placement of the strip 15 is on the top surface 16 under the label (not shown) applied to the cassette. In the composite unit, the sheath 12 adequately conceals the strip 15, allowing the strip 15 to be positioned at any convenient location on the frame 10, since the sheath 12 cannot be removed from the frame 10 as can conventional jackets or covers.

Figure 3:
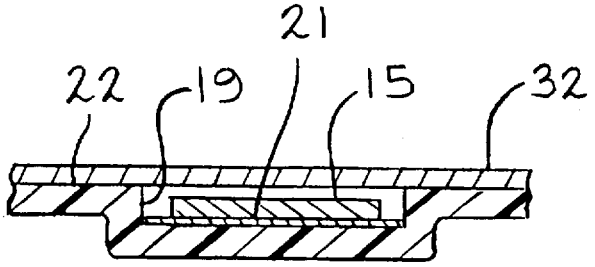
FIG. 3 is a sectional side view showing the security strip and the thin foil shield encapsulated between the plastic frame and the paperboard sheath.

In another embodiment shown in sectional in FIG. 3, a foil shield 21 is positioned proximate the frame 10 beneath the strip 15. The foil 21 is used to reflect any magnetic energy emitted by the strip 15 or by the strip deactivation process, thereby protecting the signal contained on the video or audio tape from degradation. Such foil 21 is preferably a metallic foil such as aluminum foil and can be either bonded with the same techniques used to secure the strip 15 to the frame 10 or can be encapsulated without bonding between the frame 10 and the sheath or label 12. While foil is preferred, any thin material with similar shielding properties may be used.

Deactivatable, anti-theft security strips, magnetic strips and security labels are too numerous to mention. U.S. Pat. Nos. 5,653,824, 5,583,489, 5,130,698 and the references cited therein adequately disclose the types of strips that may be used in this invention. Naturally, the strips employed by this invention must be deactivated since they will remain on frame 10 after purchase.

The frame preferred for use with this invention is described fully in U.S. Pat. No. 5,311,388 and is constructed to have the standard outside dimensions designed for use in a standard VHS playback and recording machine. The thermoplastic frame member 10 includes open cut-out areas 14 located in the top surface 16 and bottom surface 18 of the frame member 10. The cut-out areas 14 are designed to eliminate as much material and weight from the tape cassette as possible, without negatively affecting the structural rigidity of the frame member 10 and the structural support for the tape reels 20. As can be seen from the figures, the tape reels 20 are supported by cross members 22 extending perpendicularly through the cut-out areas 14. The frame member 10 is provided with two distinct thicknesses. The protective tape gate area 24, corners 26, and bottom edges 28 are designed to have a thickness of thermoplastic material that is comparable to that found in the "standard" commercial VHS cassette. The thermoplastic material of the remaining frame structure is designed to be about 0.014 to 0.018 mils thinner. The protective tape gate 24, corners 26 and bottom edges 28, are designed to have the thicker structure in order to provide the necessary strength, integrity and durability to the frame member 10. Preferably the difference in thickness between the protective tape gate 24, corners 26, bottom edges 28, and the remainder of the frame is equivalent to the thickness of the sheath 12 which is designed to encompass the frame member 10 and bond to the thinner plastic area surrounded by the protective tape gate 24, corners 26, and bottom edges 28. Thus, after the sheath 12 is bonded to the frame member 10, there will be no exposed edges of the sheath 12 which could be subject to damage.

The sheath 12 as shown in the Figures is bonded to the frame through the use of adhesives, hot melt glue and other commonly accepted methods of bonding. This sheath includes a top flap 30, bottom flap 32, end flaps 34, and back flap 36. The sheath 12 is patterned to fit on the thin portion of the plastic frame 10, within the edges provided by the protective tape gate 24, corners 26 and top edges 28 of the frame member 10. The bottom flap 32 includes holes 38 to allow access to the reels 20 and the top flap 30 is, preferably, composed of solid material. Graphics may be applied to the exterior surface of the paperboard sheath 12 prior to application and bonding of the sheath member 12 to the frame member 10.

The cassette and security strip combination of this invention is easily adapted to high speed automated application procedures, thus creating substantial time and cost savings at the retail and commercial level by eliminating the need for hand application of the strips to finished cassette products and packaging.

The security strip according to this invention makes detection and removal of the security strip without destroying the frame or sheath is virtually impossible.

The above-detailed description of the preferred embodiment is intended to illuminate the invention without necessarily limiting the scope and content of the following claims.

I claim:

1. An anti-theft tape cassette for use with a tape playback and record device comprising, in combination:

a rigid frame defining the shape of such tape cassette for supporting the reels and tape, such tape and reels being retained between a pair of opposed support members, such support members being engaged together to define opposed side panels and a back panel, and a tape gate in opposition to said back panel and extending between said two side panels;

a label adhered to the frame; and an anti-theft security strip positioned between the frame and the label, wherein a portion of the frame has an etched down area and the security strip is adhered to the etched down area.

2. An anti-theft tape cassette for use with a tape playback and record device comprising, in combination:

a rigid frame defining the shape of such tape cassette for supporting the reels and tape, such tape and reels being retained between a pair of opposed support members, such support members being engaged together to define opposed side panels and a back panel, and a tape gate in opposition to said back panel and extending between said two side panels;

a label adhered to the frame; and an anti-theft security strip positioned between the frame and the label, wherein a portion of the frame has a recessed area and the security strip is adhered to the recessed area.

3. An anti-theft tape cassette for use with a tape playback and record device comprising, in combination:

a rigid frame defining the shape of such tape cassette for supporting the reels and tape, such tape and reels being retained between a pair of opposed support members, such support members being engaged together to define opposed side panels and a back panel, and a tape gate in opposition to said back panel and extending between said two side panels;

a label adhered to the frame; and an anti-theft security strip positioned between the frame and the label, including a flexible sheath encompassing the security strip and a portion of the frame which has an etched down area.

4. A tape cassette according to claim 3, wherein the security strip is encapsulated between the sheath and the frame.

5. A tape cassette according to claim 3 wherein the flexible sheath is bonded to the frame.

6. A tape cassette according to claim 3 including a strip of metal foil positioned between the security strip and the frame, wherein the foil and the security strip are encapsulated between the sheath and the frame.

7. A tape cassette according to claim 6, wherein the metal foil is aluminum foil.

8. An anti-theft tape cassette for use with a tape playback and record device comprising, in combination:

a rigid frame defining the shape of such tape cassette for supporting the reels and tape, such tape and reels being retained between a pair of opposed support members, such support members being engaged together to define opposed side panels and a back panel, and a tape gate in opposition to said back panel and extending between said two side panels;

label adhered to the frame; and an anti-theft security strip positioned between the frame and the label, including a strip of metal foil positioned between the frame and the anti-theft security strip.

9. A tape cassette according to claim 8, wherein the metal foil is aluminum foil.

* * * * *